US007779513B2

(12) United States Patent
Dilo

(10) Patent No.: US 7,779,513 B2
(45) Date of Patent: Aug. 24, 2010

(54) DEVICE FOR THE GUIDED TRANSPORT OF A CARD WEB

(75) Inventor: Johann P. Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 330 days.

(21) Appl. No.: 11/972,003

(22) Filed: Jan. 10, 2008

(65) Prior Publication Data

US 2008/0256756 A1 Oct. 23, 2008

(30) Foreign Application Priority Data

Jan. 18, 2007 (EP) ..... 07001067

(51) Int. Cl.
*D01G 25/00* (2006.01)

(52) U.S. Cl. ..... 19/163

(58) Field of Classification Search ..... 19/163
See application file for complete search history.

(56) References Cited

U.S. PATENT DOCUMENTS 4,673,137 A * 6/1987 Bachinger et al. ..... 242/548
4,809,920 A * 3/1989 Bachinger et al. ..... 242/533.2
4,819,302 A * 4/1989 Fukuda et al. ..... 19/262
5,144,723 A 9/1992 Hohloch et al.
5,293,667 A * 3/1994 Kitamura ..... 19/262
6,195,844 B1 * 3/2001 Jourde et al. ..... 19/163

FOREIGN PATENT DOCUMENTS

GB 1035857 4/1964

* cited by examiner

*Primary Examiner*—Shaun R Hurley
(74) *Attorney, Agent, or Firm*—Jansson Shupe & Munger Ltd.

(57) ABSTRACT

The device for the guided transport of a card web has a card web transport means and a card web guiding means consisting of a plurality of curved tongues arranged at a spacing next to each other. The tongues are arranged opposite to a contact surface of the card web transport means and extend in the direction of movement of the card web. Each tongue is movable individually in a direction away from the contact surface of the card web transport means against a biasing force.

21 Claims, 9 Drawing Sheets

DEVICE FOR THE GUIDED TRANSPORT OF A CARD WEB

CROSS REFERENCE TO RELATED APPLICATION

This application claims priority to European patent application EP 07 001 067.3, filed Jan. 18, 2007.

FIELD OF THE INVENTION

The present invention relates to the field of devices for the guided transport of card webs.

DESCRIPTION OF THE PRIOR ART

The transport of card webs for fleece production is carried out starting from a card in which the card webs are made of material fibers, up to a cross lapper, in which the card web is laid to a thicker fleece having a plurality of card web layers. On the entire transport path of the card web from the card to the deposition of the card web in the cross lapper, the problem occurs that transport belts of the card web carry along entrained air due to high transport speeds. This entrained air leads to a formation of bubbles when the card web is deflected around deflection rollers or when two transport belts are joined. This air escapes laterally and leads to fluttering of the belts and to bubble formation, cracks in the card web, expansions or enlargement of the card web, i.e., generally to an inhomogeneity of the card web. When deflecting the card web around deflection rollers, the centrifugal forces occurring additionally lead to a longitudinal card web extension, which also involves the risk of a formation of pockets and folds.

It might occur even on a straight path at very high transport speeds, for instance higher than 150 m/min, that the card web detaches from the belt, which can also lead to folds and bubbles. When manufacturing a spunbonded fleece, speeds of a perforated belt onto which filaments are to be deposited of up to 600 m/min are required to convey the spundbonded fleece. It is known to hold the filaments on the perforated belt by a suction flow. See in this respect "Vlicsstoffe" of W. Albrecht et al., Verlag Wiley-VCH, Weinheim, 2000, pg. 191-199. However, the enormous above-mentioned difficulties cannot be excluded because of the high transport speeds. In card web drafters the entrained air is problematic and affects the function of the web drafter.

SUMMARY OF THE INVENTION

Thus, it is an object of the present invention to provide a device for the guided transport of a card web, in which a stable transport of the card web is ensured also at high transportation speeds and inhomogeneities in the card web caused by entrained air, fold formation or centrifugal forces are avoided.

The device for the guided transport of a car web comprises a card web transport means for moving the card web forward, said transport means having a peripheral outer surface, wherein a part of the peripheral outer surface forms at all times a contact surface for establishing a frictional contact with at least parts of the card web to be transported. Furthermore, the device comprises a card web guiding means, which comprises a plurality of curved tongues arranged at a spacing next to each other. These tongues are arranged opposite to at least a portion of the contact surface of the card web transport means. They extend in a moving direction of the card web and therefore form a guide surface for planarly guiding the card web, wherein the guide surface has a lower frictional coefficient than the contact surface of the card web transport means, and wherein each tongue can be moved individually against a force in a direction away from the contact surface of the card web transport means.

This ensures that in the case of high transport speeds of the card web the above-mentioned disadvantages are avoided.

The tongues are advantageously polished and coated by polytetrafluoroethylen to keep the coefficient as small as possible.

The tongues are for instance formed as resilient spring sheets, which makes the arrangement more cost-effective.

In another embodiment, the tongues can be formed as rigid disks which are movable against the force of a spring. Different spring forces can be assigned to different rigid disks in an especially simple manner.

In the sense of a possibly simple generation of an initial bias, the tongues can be loaded in the direction of the contact surface of the card web transport means by means of springs or weights or pneumatically.

Different biasing is required for different applications. Thus, it is advantageous that devices are provided by means of which the bias of the tongues can be set.

Different card web thicknesses can be met by devices by means of which the distance between the tongues and the contact surface of the card web transport means is adjustable.

If the adhesive forces between the card web and the card web transport means are insufficient for a correct entrainment of the car web, the surface roughness of the card web transport means must be sufficiently high that a sufficiently large coefficient of friction establishes between the transport means and the car web, which results in that the card web does not slip on the card web transport means and is safely entrained by it. For this purpose the surface of the card web transport device can possibly be structured. Its surface can for instance have a cubic structure. However, an adhesion that is too strong, for instance if the fibers of the fiber card web get jammed on the card web transport means in a manner that when releasing the card web from the card web transport means fibers remain on the surface of the card web transport means, must not occur.

In an embodiment the card web transport means is a transport belt wound around a plurality of deflection rollers. The peripheral outer surface of the transport belt forms the contact surface, wherein the part of the contact surface that opposes the card web transport means at the respective moment is always located in the peripheral portion around a card web deflection roller. In this manner it can be attained that a card web is deflected into a different direction with a discharge of entrained air taking place and disadvantageous centrifugal forces being avoided.

A device especially suitable for the transition between an upper carriage and a laying carriage of a cross lapper is obtained if the transport belt is guided at an acute angle around the card web deflection roller. Subsequently, the transport belt extends substantially horizontal starting from the card web deflection roller, and a second transport belt extends underneath at a small distance in parallel to the first transport belt. The guide property of the device is optimized in that the curvature of the tongues corresponds to the shape of a peripheral portion of the card web deflection roller.

In addition, an air discharge device for discharging entrained through the second transport belt can be arranged above the second transport belt in the area of an entrance gusset between the two transport belts, through which air discharge device a formation of folds when depositing the card web onto the second transport belt can almost fully be avoided.

This device for discharging the air entrained by the second transport belt preferably has an end portion, which extends in an inclined manner from the top to the second transport belt and which has air passage openings.

In a special embodiment, the card web transport means and the device for discharging the air entrained by the second transport belt are formed as a combined element. This reduces the total amount of machine components and reduces the manufacturing and assembly costs.

In another embodiment, the card web transport means is a card web deflection roller, which is arranged in a transitional region between a first transport belt entering in an inclined manner from the top, and a second horizontally extending lower transport belt. In this manner a hand-over of the card web from an inclined downwardly extending transport belt to a horizontal transport belt can simply take place by avoiding the formation of folds.

The curvature of the tongues advantageously corresponds to the shape of a peripheral section of the card web deflection roller.

In another embodiment, the card web transport means is a transport belt running around a plurality of deflection rollers, wherein the peripheral outer surface of the transport belt forms the contact surface, wherein the part of the contact surface that opposes the card web transport means at the respective moment extends straightly. Extremely high transport speeds can be achieved by this embodiment.

The tongues are preferably curved in the direction of the transport direction of the transport belt, and an end portion of the tongues is biased towards the transport belt. Caused by this arrangement the movement of the transport belt is opposed by a very small resistance only.

In a further embodiment, two transport belts are arranged to form a belt transition in a manner that a deflection roller of the first transport belt and a deflection roller of the second transport belt oppose one another in an axially in parallel, wherein each of the two deflection rollers is rotatable in the same direction with a speed adjustable independently, and two card web guiding means are provided, each of which being arranged above one of the two deflection rollers so that a web drafter for drafting the card web is formed. This embodiment provides an especially simple web drafter in which the air entrained by the transport belt is discharged in a simple manner and thus the formation of folds is avoided.

In another embodiment, two transport belts are arranged to form a belt transition in a manner that a deflection roller of the first transport belt and a deflection roller of the second transport belt oppose one another in an axially in parallel, wherein each of the two rollers is rotatable in the same direction with a speed adjustable independently, and the end portion of the tongues of the only card web guiding means extends over the two deflection rollers and above both deflection rollers is biased towards both transport belts so that a web drafter for drafting the card web is formed. This web drafter has the advantage that it comprises even less single components.

The invention will now be explained with reference to the embodiments shown in the drawings.

The drawings only show the parts that are essential for explaining the invention in order not to load the drawings with superfluous details.

DETAILED DESCRIPTION OF THE INVENTION

A first field of application of the device for the guided transport of a card web according to the invention is the guiding of a card web around a deflection roller so that the card web subsequently rests with its upside down. This variant can most of all be found in cross lappers.

Figure 1:
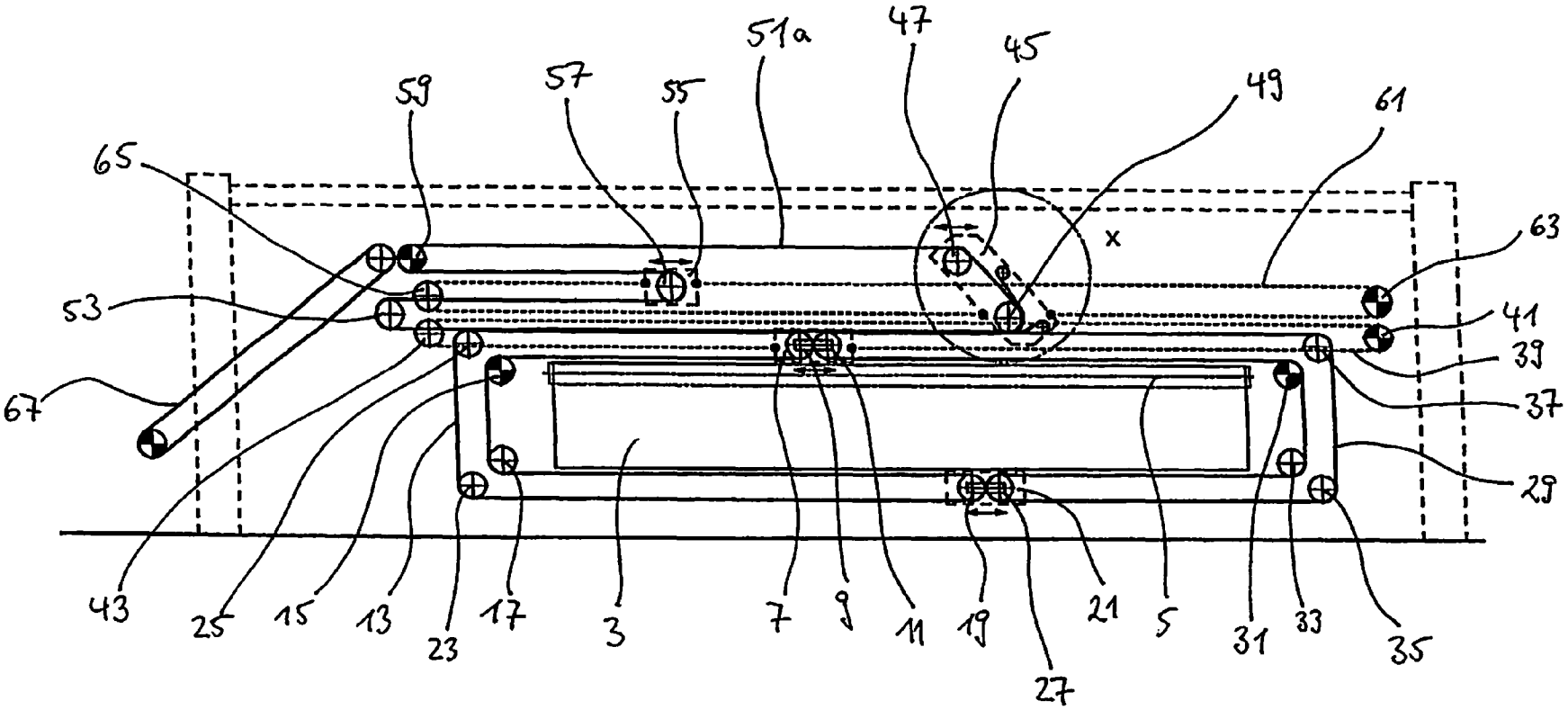
FIG. 1 is a schematic cross-sectional view of a cross lapper with a first embodiment of the device for the guided transport of a card web according to the invention.

FIG. 1 shows a schematic cross-sectional view of such a cross lapper with a first embodiment of the device for the guided transport of a card web according to the invention.

The cross lapper comprises an output conveyor belt 3, which is determined for transporting a laid fleece in a transport direction extending vertically with respect to the drawing plane. An upper deflection roller 5 belonging to guide devices of the output conveyor belt is shown in dot and dash line. A laying carriage 7 on rails (now shown) is movable back and forth above the output conveyor belt 3 in a direction transversely to the transport direction of the output conveyor belt 3. Two deflection rollers 9 and 11 are supported in a freely rotary manner in the laying carriage 7. The first deflection roller 9 is partially wound around by a first cover belt 13, which has a section that extends at a tight distance over the output conveyor belt 3 to a driven deflection roller 15 and from there via a further stationary deflection roller 17 to a deflection roller 19, which is rotatably supported in a first tensioning carriage 21, which is movable below the output conveyor belt 3 transversely thereto on rails (not shown). Starting from the deflection roller 19 supported in the tensioning carriage 21, said cover belt 13 extends over two further stationary deflection rollers 23 and 25, respectively, back to the laying carriage 7. The driven deflection roller 15 is coupled with a motor (not shown) and is determined for driving the first cover belt 13 in different directions.

Since the upper section of the second cover belt 29 also serves for the transport of a card web (now shown) into a laying nip at the laying carriage 7 formed there between the deflection rollers 9 and 11, the second cover belt 29 can also be defined as laying belt.

In a similar manner is the other deflection roller 11 rotatably supported in the laying carriage 7, is partially wound around by the second cover belt 29, which is guided through a driven deflection roller 31 and a stationary deflection roller 33 to a second deflection roller 27 supported in the tensioning carriage 21, said second deflection roller 27 being partially wound around by the cover belt 29, from which the cover belt 29 returns to the laying carriage 7 via further stationary deflection rollers 35 and 37, respectively. Thus, the second cover belt 29 has a section that extends at a tight distance over the output conveyor belt 3. The driven deflection roller 31 is also coupled to a motor (not shown) and is determined for driving the second cover belt 29 in different directions.

A chain or toothed belt 39 is attached at the laying carriage 7, said chain or toothed belt running over a drive pinion 41 and a deflection wheel 43 connected to a motor (not shown). By the aid of the drive means formed thereby, the laying carriage 7 can be moved back and forth above the output conveyor belt 3 transversely to the transport direction thereof.

In a position elevated with respect to the level of the laying carriage 7, an upper carriage 45, drawn in dotted line, is supported displaceably in the machine frame and movable in a direction transversely with respect to the transport direction of the output conveyor belt 3. The upper carriage 45 has an upper deflection roller 47 and a lower card web deflection roller 49, which are offset with respect to one another in the direction of movement of the upper carriage 45. A transport belt 51 a for the card web, hereinafter also designated as first transport belt, extends over these two rollers 47 and 49. The first transport belt 51*a* extends in an incline downwardly in the area restricted by the two deflection rollers 47 and 49 in the upper carriage 45. Starting from the lower card web deflection roller 49 in the upper carriage 45 the first transport belt 51*a* extends in parallel to the upper sections of the two cover belts 13 and 29. Since the first transport belt 51*a* guides the card web together with a section of the upper section of the second cover belt 29, it can also be designated as a laying belt.

The first transport belt 51*a* is guided via a deflection roller 53 stationarily supported in the machine frame and from there via a deflection roller 57 supported in a second tensioning carriage 55, to then run over a stationarily supported deflection roller 59 driven by a motor before it reaches the upper carriage 45 again. The upper carriage 45 and the second tensioning carriage 55 are connected to one another through a chain or a toothed belt 61, which run(s) over a drive gear 63 and a deflection wheel 65 connected to a motor (not shown), which are supported in the machine frame. A supply belt 67 extending upwards in an inclined manner can further be seen in FIG. 1, which supplies a card web to be laid (no shown) to the first transport belt 51*a*.

The first transport belt 51*a* and the second cover belt 29 are guided in parallel at a close distance to one another in the area between the lower card web deflection roller 49 of the upper carriage 45 and the second deflection roller 11 of the laying carriage 7, so that a card web supplied by the first transport belt 51*a* is enclosed in a sandwich-type manner by the first transport belt 51*a* and the second cover belt 29 in said area between the upper carriage 45 and the laying carriage 7. The card web is supported by said cover belt 29, which is why this belt is also designated as second transport belt in the sense of the present invention.

It can be seen in the drawing that in operation, when the laying carriage 7 carries out a movement reciprocating over the output conveyor belt 3, the first tensioning carriage 21 carries out an opposite movement, since the loop lengths of the cover belts 13 and 29 are constant. Furthermore, the upper carriage 45 and its associated second tensioning carriage 55 carry out movements opposite to one another in operation, since they are positively connected to one another by the chain or the toothed belt. The second tensioning carriage 55 is required to keep the loop length of the first transport belt 51*a* constant.

The present invention is used in such cross lappers to guide the card web from the first transport belt 51*a* around the lower card web deflection roller 49 in the upper carriage 45 in a reversed manner onto the second transport belt 29.

Figure 2:
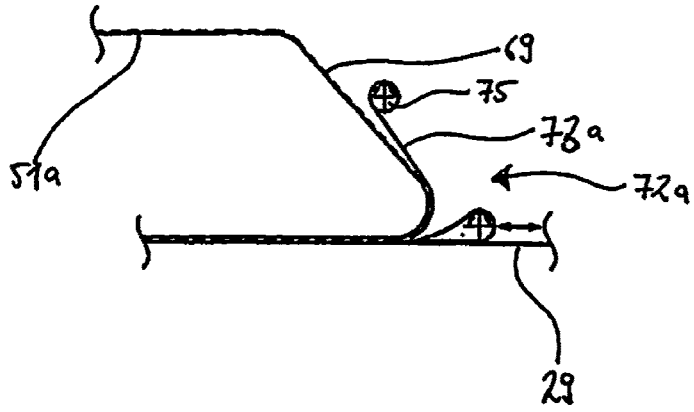
FIG. 2 is an enlarged view of the device for the guided transport of a card web according to the detail x of FIG. 1.
Figure 3:
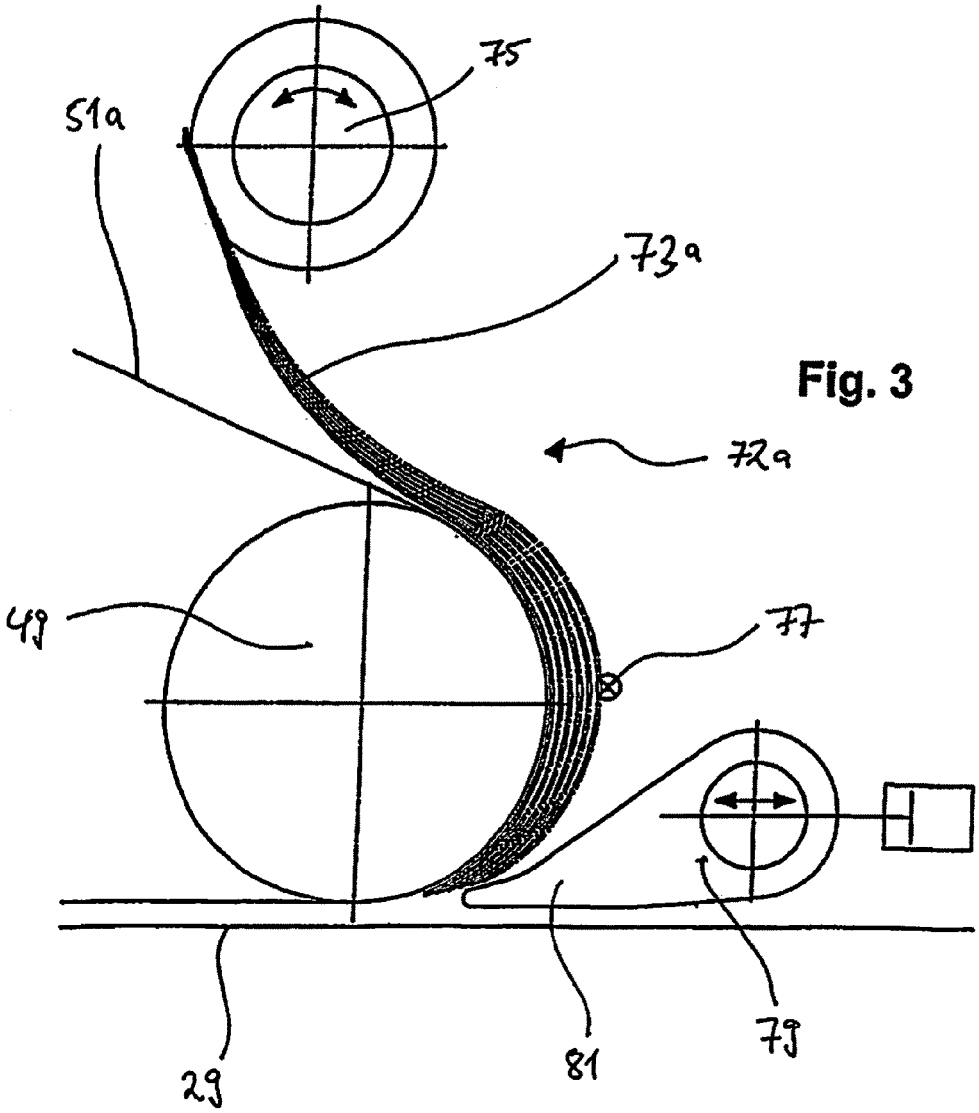
FIG. 3 is an enlarged schematic cross-sectional view of the first embodiment of the device for the guided transport of a card web according to the invention with different positions of the card web guiding means.

A detailed view according to detail x of the first embodiment shown in FIG. 1 of the device for the guided transport of a card web according to the invention is shown in FIG. 2. The card web 69 is shown in FIG. 2 in dashed line, whereas the deflection rollers 47 and 49 are omitted. FIG. 3 shows a further enlarged view of this embodiment (without a card web).

The first transport belt 51*a*, which in the context of the invention can generally also be designated as card web transport means, forms a contact surface with the card web 69 at a peripheral outer surface. The contact surface of the card web transport means 51*a* generally has a sufficiently high coefficient of friction, as is also the case in all further embodiments described below, e.g., due to a rough surface so that it entrains the card web 69 when being moved.

Besides the first transport belt 51*a*, which serves for moving forward the card web 69, the device for the guided transport of the card web also has a card web guiding means 72*a*, which in the present example is formed in the shape of a sickle-shaped rack, which has a plurality of curved tongues 73*a* arranged at a spacing to one another in juxtaposition. In FIGS. 2 and 3 only one tongue 73*a* is shown due to the cross-sectional view, whereas the other tongues are arranged in the drawing plane behind the first tongue 73*a*. The tongues 73*a* are coated preferably by polytetrafluoroethylen or polished to ensure a very low coefficient of friction, and in the example of FIGS. 2 and 3 they are formed as resilient spring sheets.

The tongues 73*a* formed as spring sheets serve for guiding the card web 69 in the area of the lower card web deflection roller 49 in the upper carriage 45 of the cross lapper, and the curvature of the tongues 73*a* corresponds to the shape of a peripheral section of the card web deflection roller 49. The peripheral portion of the card web deflection roller 49, which is surrounded by the tongues 73*a*, can preferably be slightly smaller than half of the overall periphery of the card web deflection roller 49 and is approximately defined by the portion in which the first transport belt 51*a* rests on the card web deflection roller 49. Thus, a portion is defined between the transport belt 51*a* resting on the card web deflection roller 49 and the tongues 73*a*, in which the card web 69 entrained by the transport belt 51*a* is reversed in a guided manner. At the same time, the distances between the individual tongues 73*a* ensure that air entrained by the transport belt 51*a* can escape. After travel around the card web deflection roller 49 the card web 69 is subsequently deposited on the horizontally extending section of the second transport belt 29, it is further moved by this belt up to the laying carriage 11 and covered by the first transport belt 51*a* from the top.

The tongues 73*a* formed as spring sheets are attached on a rotatable shaft 75 arranged above the lower card web deflection roller 49 in the upper carriage 45. The shaft 75 can be arranged displaceably in the radial direction, whereby the distance of the tongues 73*a* to the first transport belt 51*a* or to the lower card web deflection roller 49 can be set. By rotating the shaft 75 the bias of the spring sheets 73*a* can be set in the direction of the transport belt 51*a*. For this purpose the sickle shape of the tongues 73*a* shown is for instance suitable. Thereby, the pressure force of the tongues 73*a* onto the card web 69 in the area of the lower card web deflection roller 49 is set.

The spring sheets 73*a* have a distance to each other of, e.g., 5 to 10 mm and they can have a width of, e.g., 20 to 30 mm and a thickness of approx. 0.5 to 2 mm. They are distributed regularly across the entire width of the transport belt 51*a* which can extend over several meters.

The setting of the bias of the tongues 73*a* can be implemented mechanically by means of rotating the shaft 75, but it can also be implemented pneumatically. Besides the advantage of the discharge of entrained air through the gaps between the tongues 73*a* the shape of the card web guiding means 72*a* according to the invention also has the advantage that thick portions in the card web 69 can move individual or several tongues 73*a* against the biasing force away from the contact surface of the transport belt 51*a* without obstructing the transport procedure of the card web 69 or without affecting the rest of the remaining tongues at the card web 69. Thus, blockage in the deflection portion of the lower card web deflection roller 49 is excluded. This also applies to the following described embodiments.

Different positions of a tongue 73*a* can be seen in FIG. 3. The different positions can on the one hand be achieved in the pre-adjustment by rotating the shaft 75 to ensure an adaptation to the respective thickness of the card web 69. At the same time, the positions of the tongue 73*a* shown in dash-dot line represent a possible deflection position of the tongues 73*a* which can be caused by the card web 69 against the spring force of the tongues 73*a*.

A sensor 77 (FIG. 3) can be arranged in the area of an outer position of the tongues 73*a*. In the case of too high deflections this sensor is responsible, e.g., for an interruption of the operation of the cross lapper so that the tongues are quickly withdrawn from the card web to give space for the card web. As an alternative, the sensor 77 can also output a control command, which releases the lock of the shaft 75 so that this shaft can rotatably adjust by the action of the force of the tongues deflected onto the card web.

In addition to the described elements, a horizontally displaceable air discharge device 79 can be arranged in the area of the inlet gusset of the two transport belts 51*a* and 29 to discharge air entrained by the second transport belt 29. The device 79 for discharging the air entrained by the second transport belt 29 can be formed in one piece; however, it can also comprise an end portion 81 in which air passage openings (not visible) exist. The air discharge device 79 can for instance be formed as a resin block whose end portion 81 extends from an inclined upward position into the inlet gusset of the two transport belts 51*a* and 29.

Figure 4:
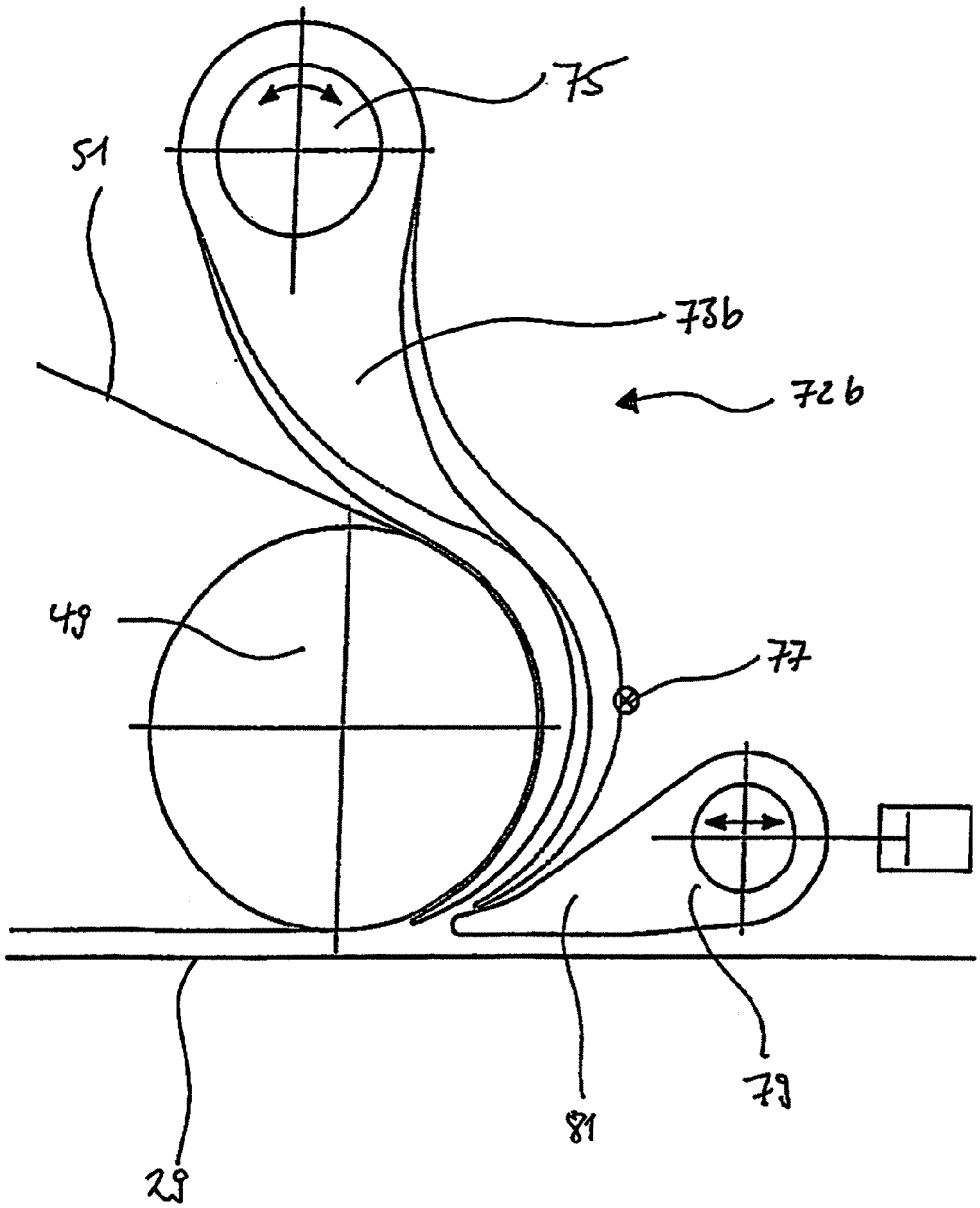
FIG. 4 is a schematic cross-sectional view of a second embodiment of the device for the guided transport of a card web according to the invention with different positions of the card web transport means.
Figure 5:
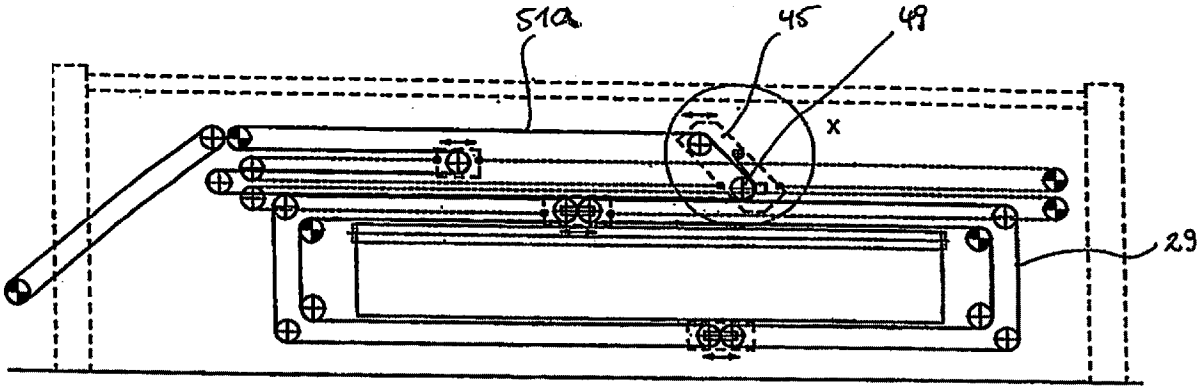
FIG. 5 is a schematic cross-sectional view of a cross lapper with a third embodiment of the device for the guided transport of a card web according to the invention.

The second embodiment shown in FIG. 4 corresponds to the embodiment of FIG. 3, except for the fact that the tongues 73*b* forming the card web transport means 72*b* are formed as sickle-shaped disks of a rigid plastic material, which can be rotated against the force of a spring against the shaft 75. FIG. 5 shows two possible positions of the tongues 73*b*.

Figure 6:
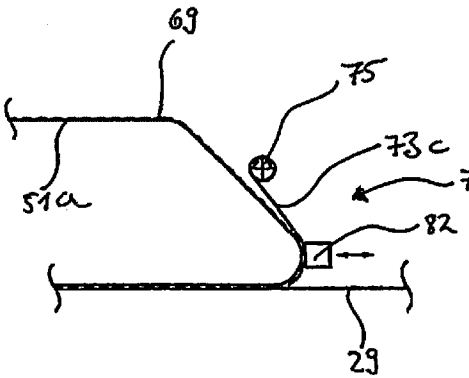
FIG. 6 is an enlarged view of the device for the guided transport of a card web according to detail x of FIG. 5.

A third embodiment of the device for the guided transport of a card web according to the invention is shown in FIGS. 5 and 6. The embodiment corresponds to the first embodiment shown in FIG. 1 to 3, except for the difference that the bias of the tongues 73*c* forming the card web transport means 72*c* is implemented individually by loads from weights 82. This has the advantage that the pressure of the tongues acting onto the card web is independent of the extent of deflection of the tongues caused by thick portions in the card web.

Figure 7:
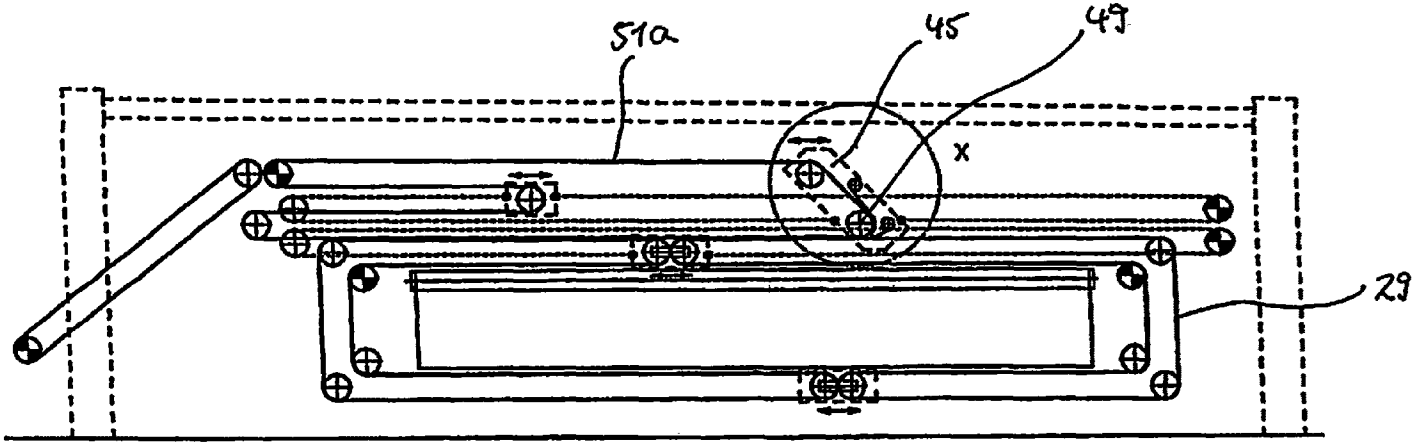
FIG. 7 is a schematic cross-sectional view of a cross lapper with a fourth embodiment of the device for the guided transport of a card web according to the invention.
Figure 8:
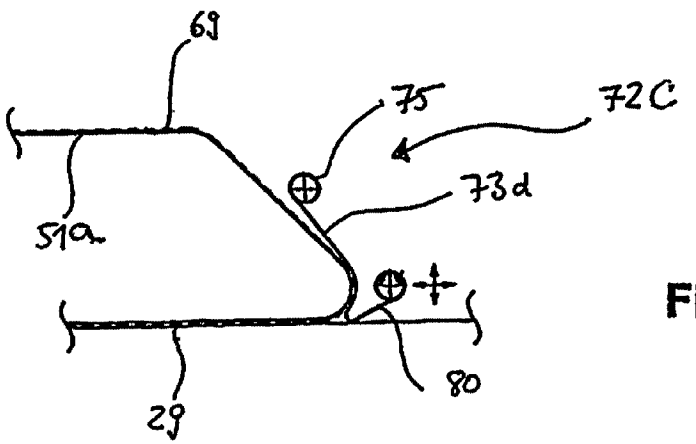
FIG. 8 is an enlarged view of the device for the guided transport of a card web according to detail x of FIG. 7.

A fourth embodiment of the device for the guided transport of a card web according to the invention, which is shown in FIGS. 7 and 8, shows a one-piece form of the tongues 73*d* and of the device 80 for discharging the air entrained by the second transport belt 29. Both elements are formed as a coherent element, whereby manufacturing costs can be saved.

Figure 9A:
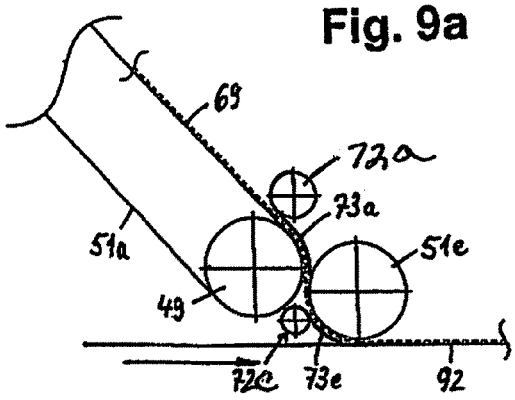
FIG. 9*a* to 9*e* are different schematic cross-sectional views of transitions between two transport belts with a fifth embodiment of the device for the guided transport of a card web according to the invention.

FIG. 9*a* shows an application of the invention in an area of the card web transport as it can be seen on the web doffing side of a card. Card web is usually taken off at a card at two portions lying behind one another in peripheral direction of the card tambour by upper and lower pick-ups as two card webs which are subsequently laid on top of each other. The card web taken off by means of the upper pick-up is doubled onto the card web taken off by means of the lower pick-up, wherein both card webs are passed towards the doubling position on card web transport devices.

FIG. 9*a* shows in this respect a further combined variant of two devices for the guided transport of a card web according to the invention. The card web 69 is entrained by a transport belt entering inclined from an upper position, said belt being guided around a card web deflection roller 49, and by means of a card web transport means 72*a* formed almost identical to the first embodiment it its first of all directed into a vertical direction. A difference to the first embodiment is that the tongues 73*a* only extend over a smaller peripheral section of the card web deflection roller 49.

The essentially vertically extending card web 69 is subsequently taken up and forwarded by a fifth embodiment of the device for the guided transport of a card web according to the invention. In this embodiment the card web transport means is formed by a deflection roller 51*e* which also has a rough surface and therefore generates a coefficient of friction with the card web 69. The deflection roller 51*e* rotates in a direction opposite to that of the card web deflection roller 49 so that a transfer of the card web 69 from a first transport belt 51*a* to a second horizontal transport belt 92 takes place without a reversal of the card web 69. A further card web can possibly be arranged on the second transport belt 92, as was mentioned with respect to FIG. 9*a*, but which is not shown in this case.

The card web transport means 72*e* is arranged opposite to a peripheral section lying in the lower portion of the card web deflection roller 51*e* and has tongues 73*e*, which are curved according to the shape of the peripheral section of the deflection roller 51*e* in the direction of movement of the card web 69 and which come very close to the second transport belt 92 with their end portions. The above-mentioned options for setting the bias and the design of the tongues can also be applied in this embodiment.

Figure 9B:
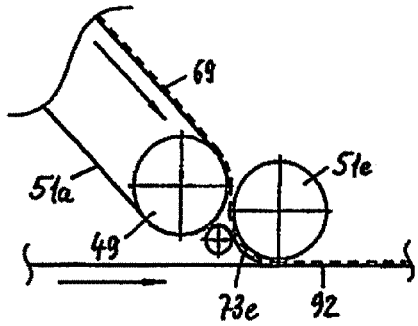

An embodiment simplified with respect to FIG. 9*a* is shown in FIG. 9*b*. It differs from the one of FIG. 9*a* in that a card web guiding means 73*e* opposes the deflection roller 51*e* only. This embodiment can be used in applications in which the requirements are not so important as in FIG. 9*a*. Furthermore, the embodiment of FIG. 9*b* corresponds to the one of FIG. 9*a*, which becomes manifest in the congruently used reference numerals only differing from one another in suffixes, which do not have to be described in detail.

Figure 9C:
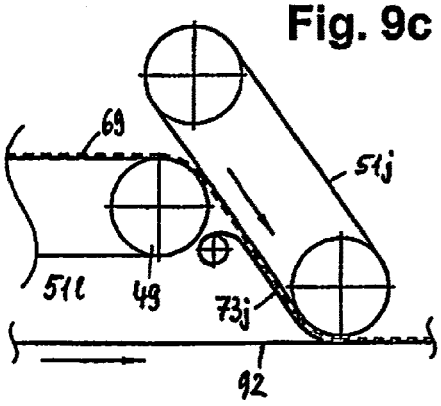

FIG. 9*c* shows a variant of the embodiment of FIG. 9*b*. It differs from the one according to FIG. 9*b* only in that the deflection roller 51*e* of FIG. 9*b* is replaced by an endlessly revolving card web transport belt 51*j* winding around two deflection rollers arranged in parallel to one another, said card web transport belt 51*j* having a downwardly leading section accompanying the card web, said section being opposed by a card web transport means arranged of a plurality of tongues 73*j* arranged at a spacing to one another and in parallel to one another. The card web transport means presses the card web against said section of the card web guiding belt 51*j*. These tongues 73*j* are formed oblong and at their lower end they are adapted to the course of the periphery of the lower deflection roller of the card web transport belt 51*j*. As shown, this embodiment of the invention is suitable for applications in which a card web transport belt 511 transporting the (upper) card web extends substantially horizontally and a decline of the (upper) card web 69 onto a lower card web transport belt 92 shall take place.

Figure 9D:
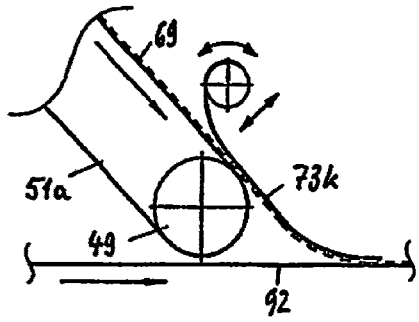
Figure 9E:
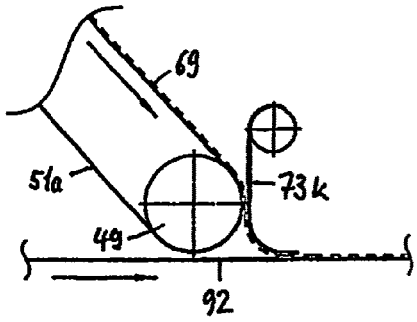

FIGS. 9*d* and 9*e* show embodiments that are simplified compared to the embodiments according to FIGS. 9*a* and 9*c*, which renounce moved card web transport means in the area of the output end of the card web transport belt 51*a* transporting the card web 69 downwards. In the embodiments according to FIGS. 9*d* and 9*e* the card web 69 is guided only by a card web transport means 73*k* having the form of a plurality of tongues arranged at a mutual distance to each other and in parallel to each other in the transfer portion from the supplying card web transport belt 51*a* to the lower, discharging card web transport belt 92. The transfer can be formed at an acute angle according to FIG. 9*d* or at a right angle with an inclined rounding according to FIG. 9*e*, which is achieved by a respective design of the card web transport means 73*k*. In the embodiments shown it is assumed that the transport speed of the lower, discharging card web transport belt 92 is somewhat higher than the speed of the upper, supplying card web transport belt 51*a* so that a certain tension is generated in the card web 69 which holds the card web in contact with the card web guiding means 73*k*.

Figure 10:
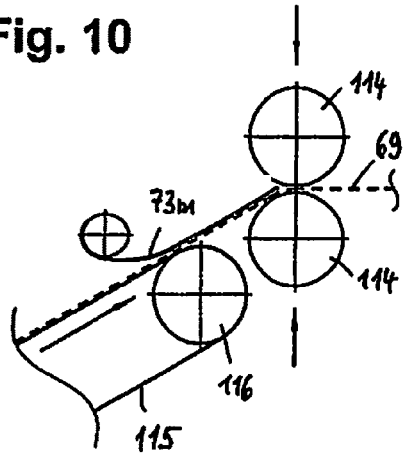
FIG. 10 is a schematic view of the application of the invention in the card web inlet of a calendar or of a cross lapper having drafting properties.

FIG. 10 shows an application of the hand-over of a card web 69 from a supply belt 115 into a clamping nip between two clamping rollers 14. The clamping rollers 114 can for instance be calendar rollers for pre-treating the card web 69, or they may be the intake rollers of a cross lapper.

A method for laying a fleece from a supplied card web is for instance described in DE 43 04 988 C1, in which by cyclically lifting and lowering the card web guiding drives of a cross lapper a card web supplied to the cross lapper by a card web generating device at constant speed is cyclically expanded and upset before entering into the cross lapper. For this purpose it is required to define a drafting zone before entering into the cross lapper whose one end is determined by the supply belt and whose other end is determined by the inlet of the cross lapper.

In accordance with FIG. 10, the inlet portion of the cross lapper is designed with two clamping rollers 114 forming a clamping nip and supply belt 115 for the card web 69 is arranged upstream thereof. Card web 69 is guided in the area between a deflection roller 116 arranged upstream of the clamping rollers 114, deflecting the supply belt 115 and the clamping rollers 114 by a card web guiding means 73*m*, which extends from the deflection roller 116 to shortly in front of the clamping nip between the two clamping rollers 114. This card web guiding means 73*m* consists of a plurality of tongues arranged at a mutual spacing with respect to each other and arranged in parallel to each other, the roots of said tongues being located on the side of the deflection roller 116 and their ends resting in the area of the lower clamping roller 114 on the card web 69. The tongues also rest at the deflection roller 116 on the card web 69 and thereby generate the required friction between the card web 69 and their respective support, which is required to generate the desired drafting effect in the sense of the teaching defined in DE 43 04 988 Cl.

Figure 11:
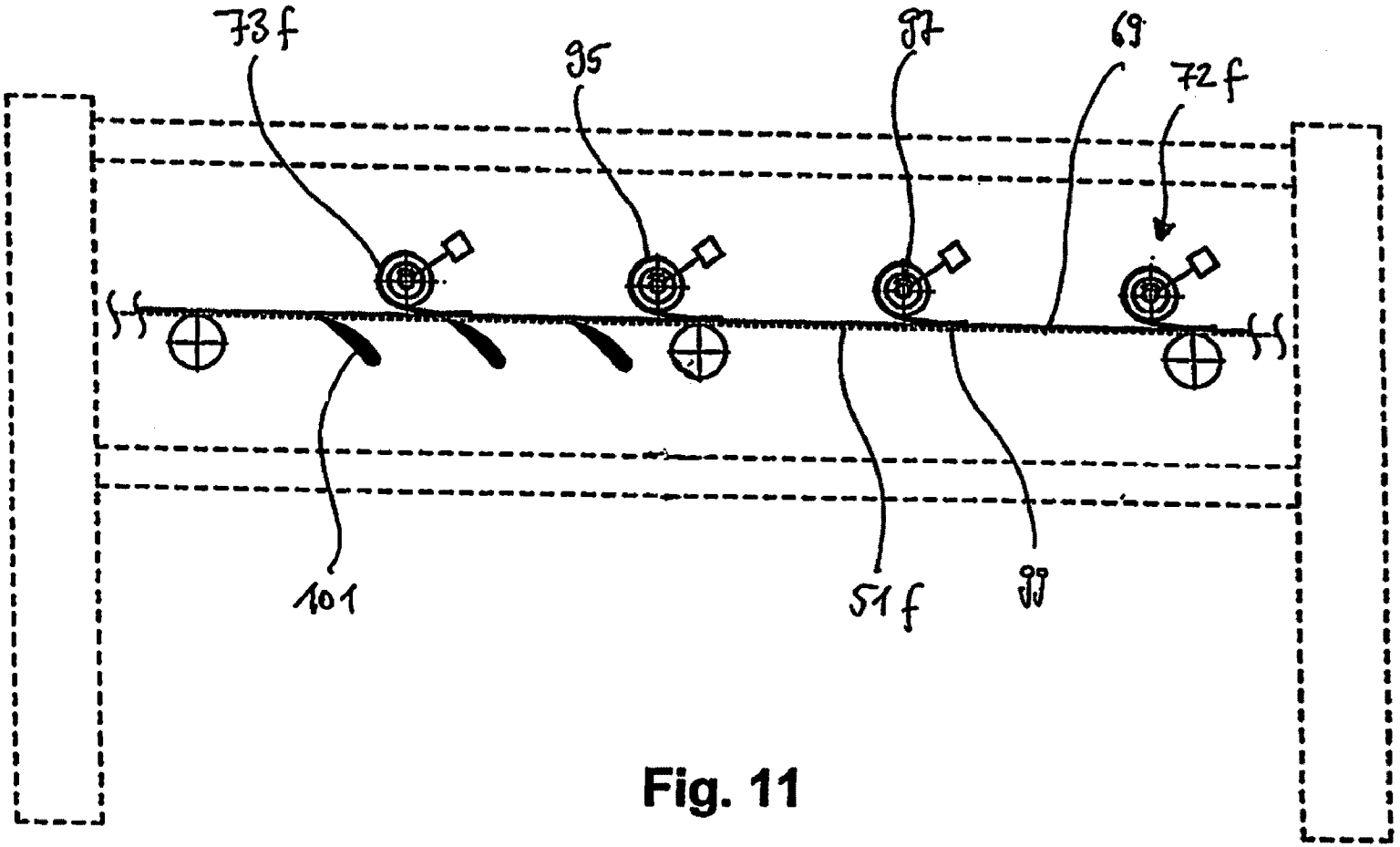
FIG. 11 is a schematic cross-sectional view of a horizontally guided transport belt with a sixth embodiment of the device for the guided transport of a card web according to the invention.

A sixth embodiment of the device for the guided transport of a card web according to the invention is shown in FIG. 11. The possible application of this embodiment is, e.g., the horizontal transport of card webs on a transport belt 51*f* revolving at a very high speed. In this case the transport belt 51*f* running in the drawing from left to right represents the card web transport means, and the card web guiding means 72*f* are tongues 73*f*, which seen from the top are biased towards the transport belt 51*f*. In this case, the tongues 73*f* are not sickle-shaped but J-shaped, wherein the bent root 95 of the tongues is wound around a shaft 97, whereas the other end section 99 pointing towards the right in the drawing is loaded planarly against the card web 69 across a certain portion. The tongues 73*f* can be made of the same materials as in the first embodiment, and the different setting options of the pressure can also be applied. In addition to the force built up by the tongues 73*f*, which shall prevent a lifting of the card web 69, air entrained above the transport belt 51*f* is discharged through the tongues 73*f*. If the transport belt 51*f* is formed as a perforated belt, as is for instance common for transporting a spunbonded fleece from a spunbonded fleece system, additional means for discharging entrained air can be provided below the transport belt 51*f*, for instance the shown discharging elements 101 which have a cross section that resembles the wings of aircrafts. In the case of longer transport ways it is sensible to arrange a plurality of card web guiding means 72*f* behind one another.

Figure 12:
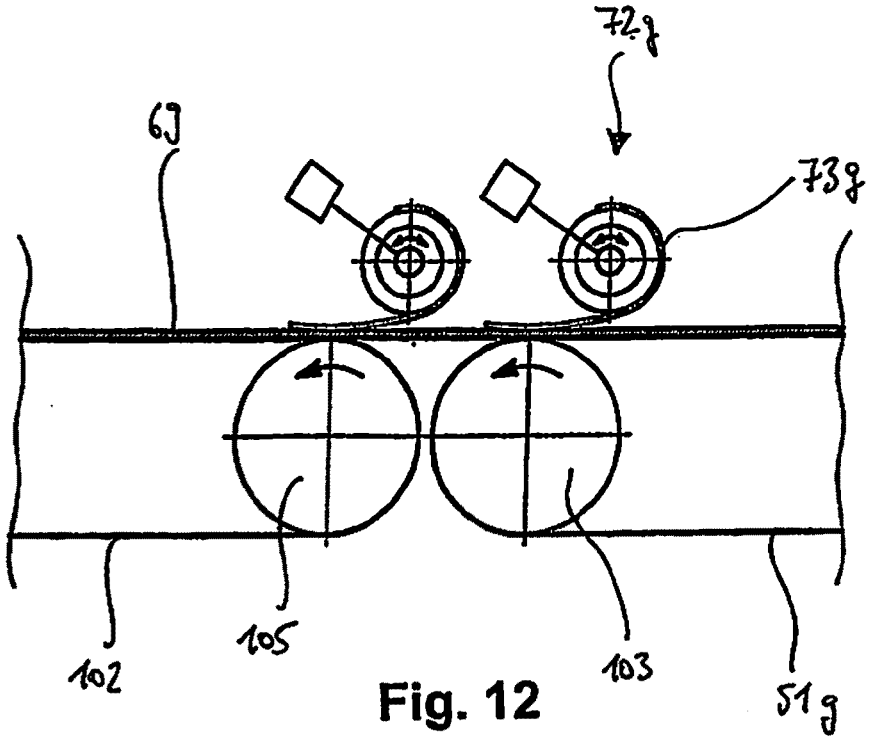
FIG. 12 is a schematic cross-sectional view of a web drafter with a seventh embodiment of the device for the guided transport of a card web according to the invention.
Figure 13:
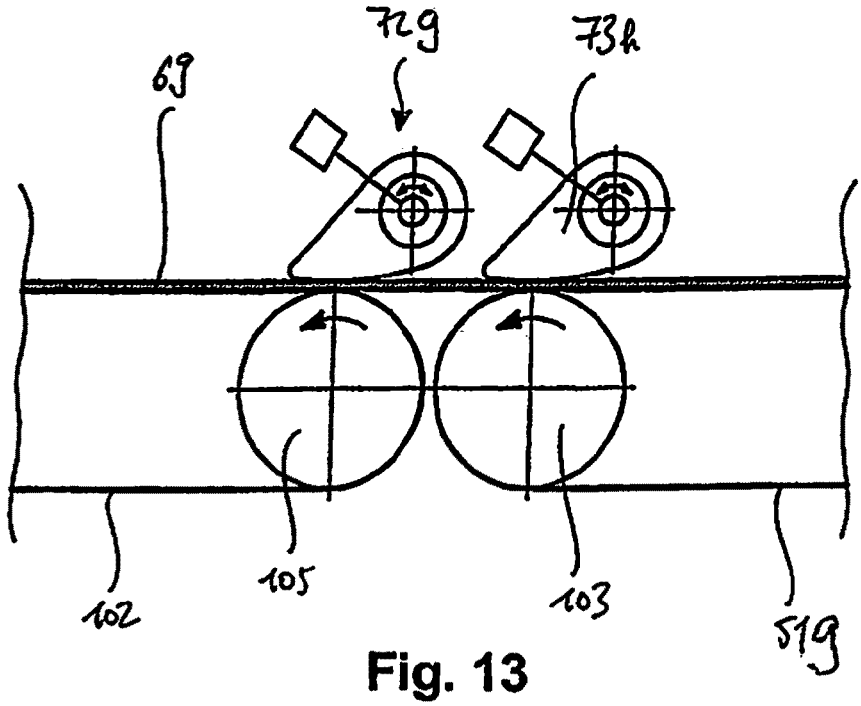
FIG. 13 is a schematic cross-sectional view of a web drafter with an eighth embodiment of the device for the guided transport of a card web according to the invention.
Figure 14:
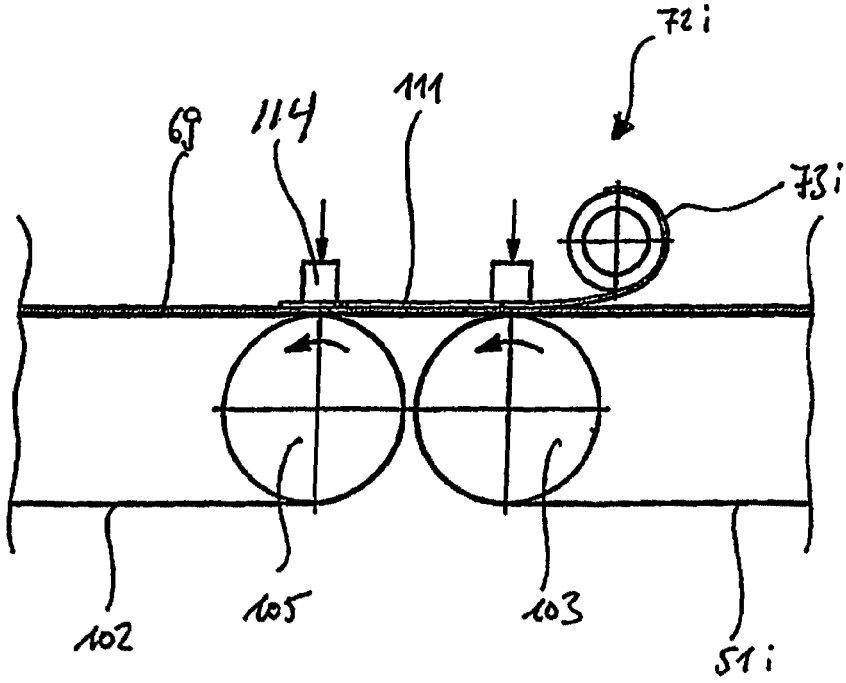
FIG. 14 is a schematic cross-sectional view of a web drafter with a ninth embodiment of the device for the guided transport of a card web according to the invention.

A seventh embodiment of the device for the guided transport of a card web according to the invention can also be used in a card web drafter. FIGS. 12 to 14 show different embodiments of such an application. In the belt transition from a first transport belt 51*g* to a second transport belt 102 formed by the web drafter, the first transport belt 51*g* is guided around a first deflection roller 103, while the second transport belt 102 is guided around a second deflection roller 105. Both deflection rollers 51*g*, 102 oppose one another, are on parallel axes and rotate in the same direction. However, their speed can be set independent to one another. A card web guiding means 72*g* with tongues 73*g* is arranged above the deflection rollers 103, 105 in the manner described above. Caused by the bias of the tongues 73*g* towards the card web 69, the pressure can be set variably in a manner that such arrangement can be used as a web drafter for the card web 69. For this purpose only, the second deflection roller 105 and thus the second transport belt 102 must move slightly faster than the first deflection roller 103 and thus the first transport belt 51*g*, whereby between the two clamping positions above the deflection rollers 103, 105 formed by the tongues 73*g* of the card web guiding device 72*g* the card web is expanded in the direction of movement and is thus drafted to form a thinner card web 69.

As shown in the eighth embodiment of the device for the guided transport of a card web according to the invention shown in FIG. 13, the use of spring disks 73*h* arranged at a spacing with respect to each other instead of spring sheets is conceivable.

When handing over a card web from a transport belt to a second transport belt following on the same level, a guide of the card web is particularly required if, due to the large width of the card web, the deflection rollers of the card web transport belts must have a relative large diameter due to strength reasons. In the case of a card web width of, e.g., 5 meters the deflection rollers have a diameter of up to 300 mm, and the length of the gusset between the rollers that has to be bridged by the card web lies in this range.

FIG. 14 shows a ninth embodiment of the device for the guided transport of a card web according to the invention. One single card web guiding means 72*i* only with tongues 73*i* is described whose end portion 111 resting on the card web 69 extends over both deflection rollers 103, 105 of a card web transition portion between two card web transport belts 511 and 102 connected to one another and is loaded by respective weights 114 at the respective clamping positions.

Any combinations of the element of the embodiments of the device for the guided transport of a card web according to the invention, which are described in detail, are also conceivable.

The invention claimed is:

1. Device for the guided transport of a card web, comprising:

a card web transport means for moving the card web forward, the card web transport means having a peripheral outer surface, wherein at all times a part of the peripheral outer surface forms a contact surface for establishing a frictional contact with at least parts of the card web to be transported; and a card web guiding means having a plurality of curved tongues arranged at a spacing next to each other and arranged opposite to at least part of the contact surface of the card web transport means, the tongues extending in the direction of movement of the card web and therefore forming a guide surface for planarly guiding the card web, wherein the guide surface has a lower coefficient of friction than the contact surface of the card web transport means and wherein each tongue is movable individually against a force in the direction away from the contact surface of the card web transport means.

2. Device as claimed in claim 1 wherein the tongues are polished or coated by polytetrafluoroethylene.

3. Device as claimed in claim 1 wherein the tongues are resilient spring sheets.

4. Device as claimed in claim 1 wherein the tongues are rigid disks movable against the force of a spring.

5. Device as claimed in claim 1 wherein the tongues are biased towards the contact surface of the card web transport means by means of springs or weights or pneumatically.

6. Device as claimed in claim 5 wherein devices are provided by means of which the bias of the tongues is adjustable.

7. Device as claimed in claim 1 wherein devices are provided by means of which the distance between the tongues and the contact surface of the card web transport means is adjustable.

8. Device as claimed in claim 1 wherein the card web transport means is a transport belt running over a plurality of deflection rollers, the peripheral outer surface of the transport belt forming the contact surface, wherein the part of the contact surface, which at the respective time opposes the card web guiding means, is always located in the belt contact range of a card web deflection roller.

9. Device as claimed in claim 8 wherein the transport belt is guided at an acute angle around the card web deflection roller.

10. Device as claimed in claim 8 wherein the transport belt substantially extends horizontally starting from the card web deflection roller, and wherein a second transport belt extends below at a small distance in parallel to the first transport belt.

11. Device as claimed in claim 8 wherein the curvature of the tongues corresponds to the shape of a peripheral section of the card web deflection roller.

12. Device as claimed in claim 10 wherein a device for discharging air entrained by the second transport belt is arranged in the area of an inlet gusset between the two transport belts.

13. Device as claimed in claim 12 wherein a device for discharging the air entrained by the second transport belt comprises an end portion, which extends from an inclined upward position to the second transport belt and has air passage openings.

14. Device as claimed in claim 13 wherein the card web transport belt and the device for discharging the air entrained by the second transport belt are formed as a coherent element.

15. Device as claimed in claim 1 wherein the card web transport means is a card web deflection roller, which is arranged in the transitional range between a first transport belt entering in an inclined direction from above and a second lower transport belt extending horizontally.

16. Device as claimed in claim 15 wherein the curvature of the tongues corresponds to the shape of a peripheral section of the card web deflection roller.

17. Device as claimed in claim 1 wherein the card web transport means is a transport belt running around a plurality of deflection rollers, wherein the peripheral outer surface of the transport belt forms the contact surface, wherein the part of the contact surface that opposes the card web guiding means at the respective moment extends straightly.

18. Device as claimed in claim 17 wherein the tongues are curved in the direction of the transport direction of the transport belt and an end portion of the tongues is biased towards the transport belt.

19. Device as claimed in claim 17 wherein a roller is arranged below the part of the contact surface, which at the respective moment opposes the card web guiding means.

20. Device as claimed in claim 19 wherein two transport belts are arranged with respect to one another to form a belt transfer section in a manner that a deflection roller of the first transport belt and a deflection roller of the second transport belt oppose one another in an axially parallel manner, wherein each of the two deflection rollers is rotatable in the same direction with an independently adjustable speed, and wherein two card web guiding devices are provided, each of which being arranged above one of the two deflection rollers, so that a web drafter for drafting the card web is formed.

21. Device as claimed in claim 19 wherein two transport belts are arranged with respect to one another to form a belt transfer section in a manner that a deflection roller of the first transport belt and a deflection roller of the second transport belt oppose one another in an axially parallel manner, wherein each of the two deflection rollers is rotatable in the same direction with an independently adjustable speed, and wherein the end portion of the tongues of the only card web guiding device extends over both deflection rollers and is biased towards both transport belts above deflection rollers so that a web drafter for drafting the card web is formed.

* * * * *